US008070539B2

(12) United States Patent
Carlson

(10) Patent No.: US 8,070,539 B2
(45) **Date of Patent: *Dec. 6, 2011**

(54) WATER INTAKE GRILL FOR PERSONAL WATERCRAFT

(76) Inventor: Morley Richard Carlson, Albertville, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/806,072

(22) Filed: Aug. 5, 2010

(65) Prior Publication Data

US 2010/0330855 A1 Dec. 30, 2010

Related U.S. Application Data

(63) Continuation-in-part of application No. 12/380,267, filed on Feb. 25, 2009, now Pat. No. 7,794,294, which is a continuation-in-part of application No. 11/906,603, filed on Oct. 2, 2007, now Pat. No. 7,520,789.

(51) Int. Cl.
*B63H 11/01* (2006.01)

(52) U.S. Cl. ..... 440/46

(58) Field of Classification Search ..... 440/46
See application file for complete search history.

(56) References Cited

U.S. PATENT DOCUMENTS

| | | | |
|---|---|---|---|
| 3,040,695 | A | 6/1962 | Austin |
| 3,147,733 | A | 9/1964 | Engel |
| 3,253,567 | A | 5/1966 | Patton |
| 4,027,617 | A | 6/1977 | Ikeda et al. |
| 4,437,841 | A | 3/1984 | Stallman |
| 5,096,373 | A | 3/1992 | Struve et al. |
| 5,690,520 | A | 11/1997 | Rheault |
| 5,779,508 | A | 7/1998 | Pettesch et al. |
| 7,520,789 | B1 | 4/2009 | Carlson |
| 7,794,294 | B2 | 9/2010 | Carlson |

OTHER PUBLICATIONS

R&D Aquavein & Worx Racing Maxiloader Intake Grates, Online Product Catalog Search at www.denniskirk.com, Sep. 1, 2009, (on pp. 2-4 of enclosed ref. R1).

R&D Aquavein & Solas Intake Grates, Online Product Catalog Search at www.denniskirk.com, Sep. 1, 2009, (on pp. 1-2 of enclosed ref. R2).

PWC Intake Grates for or by Yamaha, Solas, UMI Racing, Worx,and R&D Aquavein, Online Product Catalog Search at www.justatv.com, Sep. 1, 2009, (on pp. 1,4-7 of enclosed ref. R3.

Performance Intake Grates, Online Product Catalog Search at www.PWCMuscle.com, Feb. 22, 2011, (on p. 1 of enclosed ref. R4).

*Primary Examiner* — Stephen Avila
(74) *Attorney, Agent, or Firm* — Michael A. Mochinski

(57) ABSTRACT

A water intake grill for attachment to a water intake port associated with a jet watercraft, the water intake grill comprising a plurality of elongate members mounted to and in between fore and aft mounts. The fore mount comprising a base having an angularly orientated bottom surface for attaching first ends of the elongate members and an angularly orientated top surface for mounting atop thereof a key element having an overall geometric structure suited to fit within a mount socket integral to a forward wall section of the water intake port. The aft mount comprising a horizontally positioned base for accepting thereon at least one spacer and mounting thereto an extension support to support apart therefrom a cross support member for attaching second ends of the elongate members. Each elongate member comprising a teardrop geometric profile that effectively reduces the amount debris into the water intake port while allowing continued passage of water into the water intake port to yield sustained operating performance of the jet watercraft.

23 Claims, 15 Drawing Sheets

WATER INTAKE GRILL FOR PERSONAL WATERCRAFT

CROSS-REFERENCE TO RELATED APPLICATIONS

This application is a continuation-in-part of application Ser. No. 12/380,267, filed Feb. 25, 2009, now U.S. Pat. No. 7,794,294 which is a continuation-in-part of application Ser. No. 11/906,603, filed Oct. 2, 2007, now U.S. Pat. No. 7,520, 789, each of the above being entitled "Water Intake Grill for Personal Watercraft," the disclosures of which, including all attached documents, are incorporated herein by reference in their entirety for all purposes.

FIELD OF THE INVENTION

The present invention is directed to a water intake grill for attachment to a water intake port of a personal watercraft, namely a jet watercraft. More specifically the water intake grill effectively mitigates the entry of debris and foreign matter such as water grasses and moderately- to large-sized rock into the water intake port, sufficiently of which results in continued performance and a reduced occurrence of damage to the water jet propulsion system inherently included as part of the jet watercraft.

BACKGROUND OF THE INVENTION

The use of boats is a very popular recreational activity. The popularity of this recreational activity has led to a wide variety of boat designs, including by way of example, classic sailboats, boats specifically designed to improve the fishing experience, boats designed for speed and racing, and pontoon boats with a large flat deck designed to accommodate a number of individuals for socializing, eating, sunbathing, and swimming. Just as diverse as the number of boat designs is the number of options for propelling a boat through the water.

Sails capture the wind for propulsion and internal combustion engines turn one or more propellers to swiftly propel a boat through the water. Internal combustion engine configurations include outboard motors that are primarily attached to an exterior portion of a hull or transom of a boat with a propeller extending downwardly into the water for propulsion. Conversely, internal combustion engines are preferentially located within the confines of the boat where a shaft generally extends through the length of the boat's hull and exits through a watertight seal to permit connection to and rotate an external propeller to power the boat through the water. Placing an internal combustion engine inside a boat also lends to another form of boat design and propulsion possible: a jet boat that incorporates features of a water jet pump.

A jet boat is primarily propelled along the surface of a body of water such as a lake or ocean via a water jet propulsion system. Powerful motors draw in volumes of water from the lake or ocean and expel a stream of water from the stern of the boat with such extreme force that it swiftly propels the jet boat through the water. This water jet design in particular requires large volumes of water to be drawn into and expelled from a water jet. The powerful motors that are used in this configuration create a tremendous amount of suction to draw the large amounts of water into the system necessary to propel these boats at the desired operating speeds.

A jet boat of the type known in the art eliminates the presence of an external propeller, which offers a significant advantage to boaters. By reducing the risk of injury from a propeller, water jet propulsion has enabled greater human interaction with the boat and the water. This design element has made a number of smaller more unique boats possible, primarily those that can be operated by a lone operator. Many examples of these personal watercrafts exist as their popularity has expanded over past years.

For instance, personal watercraft manufacturers have adapted jet boat water jet propulsion technology into a unique boat design and application. Where a jet boat would accommodate one or typically two or more riders who enter and are seated in the jet boat, personal watercraft are smaller and more commonly designed for one operator to straddle the watercraft similar to a snowmobile or motorcycle. In another variation, the design of the Jet Ski®, as pioneered and trademarked by the Kawasaki Corporation of Japan, simulates water skiing by riders of these vehicles, primarily allowing one to stand and operate a steering handle while the water jet propels a single hull ski under the rider's feet. These unique applications of water jet technology are significant because they allow use of personal watercraft in areas where one would not typically expect to travel with a larger jet boat. This design coupled with its unique propulsion system has greatly expanded the use of personal watercraft for leisure recreational activity, water rescue activity, and for competitive sporting activities. Smaller bodies of water where boats are less common are now home to the smaller more versatile personal watercraft. Personal watercrafts because of their small size are easier to launch into shallow water than conventional boats. Personal watercrafts are typically lighter and have smaller trailers than larger-sized boats, such that it is possible for a lone user to launch a personal watercraft for a day of water recreation. Their unique propulsion system is free of externally mounted motors and propellers, thus making it easier to launch and use personal watercraft in smaller bodies of water and in shallow water. Smaller bodies of water and shallow areas do, however, present unique challenges to personal watercraft use and operation.

Smaller bodies of water and shallow areas are common places where one can find an accumulation of natural and manmade debris such as rocks, trash, dead fish, algae, and weeds. By the nature of both how the water jet propulsion system of personal watercraft operates and where users of personal watercraft choose to use these vehicles, personal watercraft are prone to problems with natural and manmade debris. The powerful motors of these vehicles have an inadvertent tendency to draw in water simultaneously with that of the debris that may consequentially harm the water jet propulsion system. Debris can enter the water inlet port of a water jet propulsion system and block or restrict the flow of water through the water jet. Any sufficient blockage of water flow can decrease performance of a water jet and may prevent it from functioning in a proper manner. Debris such as rocks can break or damage vital operable components of the water jet system which may necessitate expensive repairs. Some water jet systems are designed to use water to not only propel the watercraft, but also to divert a portion of that water stream to cool the internal combustion engine.

Internal combustion engines that are not properly cooled will accelerate the breakdown of lubricating oils and cause premature engine wear, ultimately of which may render the vehicle inoperable. In other instances, excessive debris in the water jet propulsion system could cause the engine to perform poorly and operate at higher revolutions per minute stressing the engine parts thereby greatly reducing the overall operational life of the personal watercraft.

There have been numerous attempts in the art to solve the aforementioned problems, including the attachment of a screen to the intake port that is adaptably designed to prevent the entry of debris and like matter into the jet propulsion system, notably of the type described in U.S. Pat. No. 3,040,695 entitled "Intake Strainer." However, the nature of screen construction in and of itself may act as an impediment to water flow into water jet pump. In fact, a poorly designed screen may disrupt the laminar water flow characteristics along the boat's hull. Furthermore, a screen of this type may further create turbulent, air-entrained water mixtures that when fed into the water inlet port of the water jet pump may appreciably decrease the efficiency of the jet watercraft. Screens also have the disadvantage of becoming unduly obstructed by the presence of debris that may be inadvertently held for some time onto the surficial portion of the screen, as principally established by the powerful suction of the jet water pump.

To address the problem of clogged screens, the prior art offers numerous examples of screens with mechanical cleaning components such as that depicted in U.S. Pat. No. 3,253,567 entitled "Mechanism for Use in Conjunction with the Intake Opening of a Water Jet Propelled Vehicle." These devices are extremely complex and the additional moving parts make them susceptible to higher requirements of service and maintenance and ultimately breakage. More modern personal watercrafts incorporate an intake guard configured with a pair of extended finned members connected to mounts that adaptably fit atop the water inlet port, generally being perceived to be less complex than the screen designs noted herein. Compared to such complex screen designs, the intake guard has a lower cost of manufacture and can be easily installed in new and existing jet watercraft. While the intake guard inherently offers these distinct design advantages, it may be ineffective as functioning as a barrier to water-borne debris, particularly moderately-sized rocks that can be semi-permanently trapped within the extended finned members, and protecting the water jet pump and associated operable components from damage.

Without attempting to modify the existing two bar screen design noted above, other attempts are documented in the art to address the nature of a clogged screen, including a manual cleaning device described in U.S. Pat. No. 5,690,520 entitled "Weed Removal Apparatus for a Jet Pump Propelled Watercraft." This sort of manual cleaning device presents several challenges, including the requirement of transporting and stowing the device during nonuse and awkwardness of using the device to fully appreciate its stated utility. In fact, novice personal watercraft users many not recognize the appropriate time to use such a manual device, particularly during times of jet watercraft operation.

In other attempts to solve this problem, especially in areas where vine-like water weeds are present and pose a common problem, the screen may be configured to allow one to open and reach into the water inlet chamber and water jet to manually remove weeds. This type of inlet screen with opening capabilities is described in U.S. Pat. No. 4,027,617 entitled "Grating Apparatus for Protecting the Draft Port of a Water Jet Propulsion System." This type of device is described as having a plurality of moving parts and springs that may have a tendency to prematurely wear and fail over a period of time. Another significant problem with the opening inlet screen is that it presumes weeds will enter the system and does little to prevent weeds from entering the system. Other attempts noted in the art to solve this problem have sought to block weeds from entering the water jet pump, such as the device described in U.S. Pat. No. 5,779,508, entitled "Anti-clogging Water Jet Craft," wherein extra appendages are attached to the bottom of the watercraft to block debris and like matter. This extra appendage, however, complicates the process of launching and trailering personal watercraft and reduces the desirable attribute of operating personal watercraft in shallow water.

Further attempts are noted in the art, including the alteration of the screen as described in U.S. Pat. No. 3,147,733 entitled "Inlet Screen," wherein the tines of the screen are attached to only one end of the screen. This design relies on the vibration of the engine and water flow under the boat's hull to cause the debris to remove itself from the inlet screen. This design lacks durability as the tines by design may unduly vibrate as a result of being attached to only one end. Also, this design does not solve the problem of solid compact debris, notably large rocks, which can enter the end of the screen where the tines are not attached.

Accordingly, there remains a need for a jet watercraft intake grill comprising solid, single piece construction, particularly of which prevents water-borne debris from entering into the water jet pump, functions without rider intervention, provides for an improved condition of laminar water flow into the water intake port of the water jet pump, permits continued operation of the jet watercraft in shallow water without undue obtrusiveness, and furthers the ease of loading and unloading the personal watercraft into a body of water.

BRIEF SUMMARY OF THE INVENTION

In order to overcome the numerous drawbacks apparent in the prior art a water intake grill has been devised for adaptation and use with a jet watercraft of the type commonly known and available in the art to carry and transport one or more persons over a surface of a body of water.

It is an object of the present invention to provide a water intake grill that is sufficiently capable of mitigating the entry of water-borne debris such as suspended weeds and moderately- to large-sized rocks into a water intake port of a jet watercraft.

It is another object of the present invention to provide a water intake grill that is easily manufactured as a solid, single piece to yield reliable, durable performance and lessen the overall cost of manufacture.

It is another object of the present invention to provide a water intake grill that effectively reduces costly repairs and operational downtime generally associated with a jet watercraft's factory-installed intake guard.

It is another object of the present invention to provide a water intake grill that improves the laminar water flow characteristics through the water jet inlet port and into the water jet pump of the jet watercraft to sustain its performance as configured and designed by the manufacturer.

It is another object of the present invention to provide a water intake grill that moderately improves fuel efficiency of a jet watercraft by means of sustaining adequate water flow into and through the water jet propulsion system.

It is another object of the present invention to provide a water intake grill that adaptably fits to a variety of jet watercrafts through usage of detachable key elements and spacers specifically suited to accommodate and correspond with the unique design configuration of mount sockets associated with the stock water jet inlet port.

It is yet another object of the present invention to provide a water intake grill which accomplishes the foregoing and other objects and advantages and which is economical, durable, and fully effective in performing its intended functions without unduly compromising the performance of the jet watercraft.

In accordance with the present invention, a water intake grill has been devised for easy installation and replacement of a factory-installed intake guard commonly associated with a water intake port of a stock jet watercraft, the water intake grill preferentially comprising a plurality of elongate member situated in between and attached to fore and aft mounts, the fore mount having a base with angularly orientated top and bottom surfaces and a key element optionally mounted atop the angularly orientated top surface, the key element comprising top and bottom facing sides integrally connected by pitched sides to collectively form an overall geometric structure substantially suited to configurably fit within the geometric configuration of a mount socket integral to a forward wall section of the water intake port, the aft mount comprising a horizontally positioned base having a geometric structure substantially coinciding with the geometric configuration of a rearward recess integral to a rearward wall section of the water intake port and rearward and forward sections, the rearward section being suited to optionally receive and rest atop thereof one or more spacers, the forward section being suited to mount and receive thereon a rearward end of an extension support, the extension support further comprising a forward end integrally joined to a cross support member equipped with an angular edge for receiving and attaching second ends of the elongate members, each elongate member comprising a teardrop geometric profile incorporating an outward bottom section having a general rounded appearance and a tapered top end having sides commencing from an apex and extending angularly outward toward the outward bottom section, a geometric profile of which effectively reduces the amount of debris into the water intake port while allowing continued passage of water into the water intake port to yield sustained operating performance of the jet watercraft and maintain effective cooling of the combustion engine generally associated with the jet watercraft.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is considered to exemplify the principles of the present invention and is not intended to unduly limit the invention to the embodiments illustrated and presented herein. The present invention has particular utility as a device for minimizing the passage of debris and foreign matter of the type commonly resting on the bottom of and/or suspended in a body of water into a water intake port of a jet watercraft while simultaneously permitting the continuous passage of water into and through the water intake port of the jet watercraft to promote its effective operation as configured and designed by the manufacturer.

Figure 1:
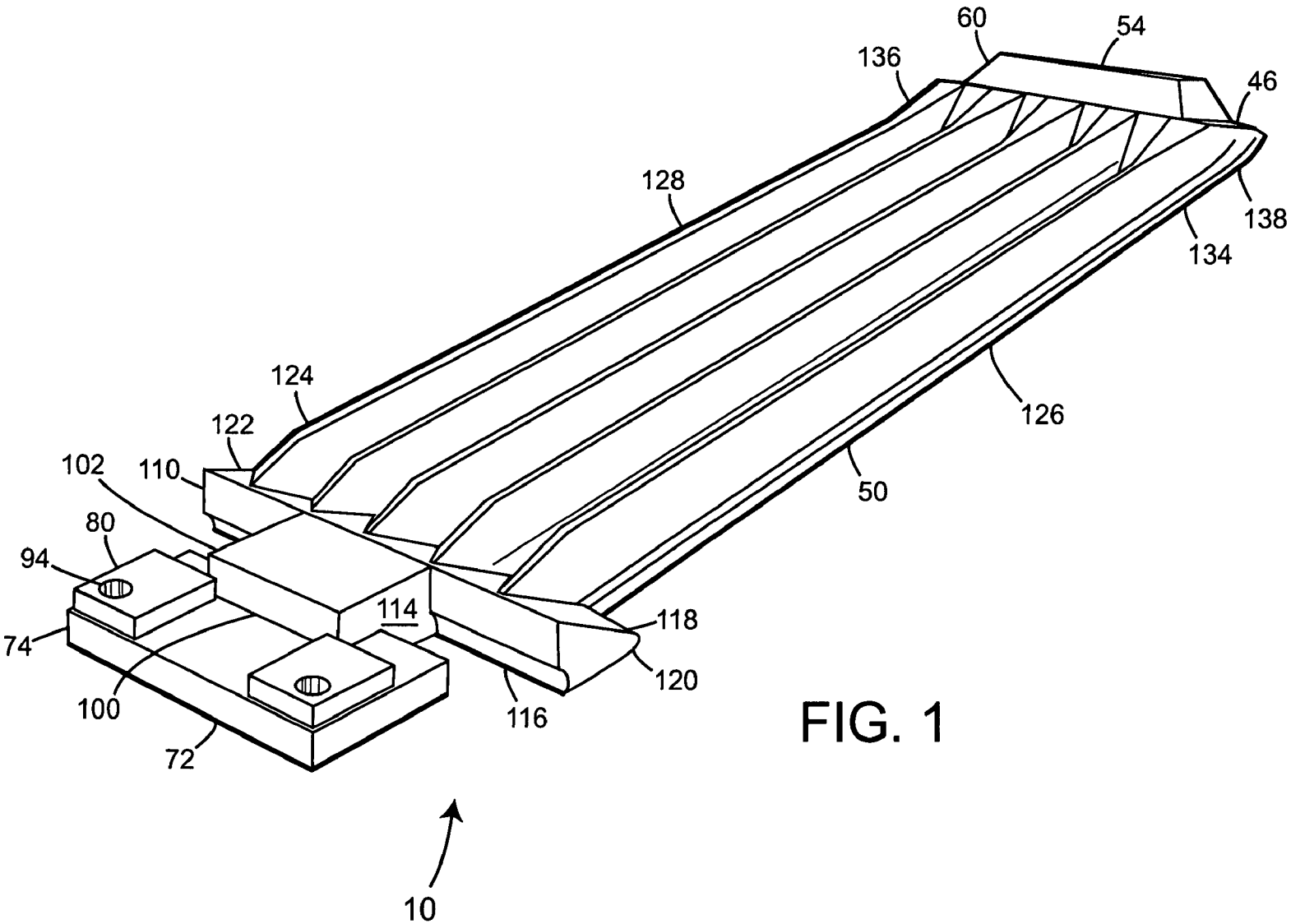
FIG. 1 is a perspective view of the preferred embodiment of the present invention illustrating a plurality of elongate members situated in between and connected to fore and aft mounts and a key element mounted atop the fore mount and a pair of spacers mounted atop the aft mount.
Figure 2:
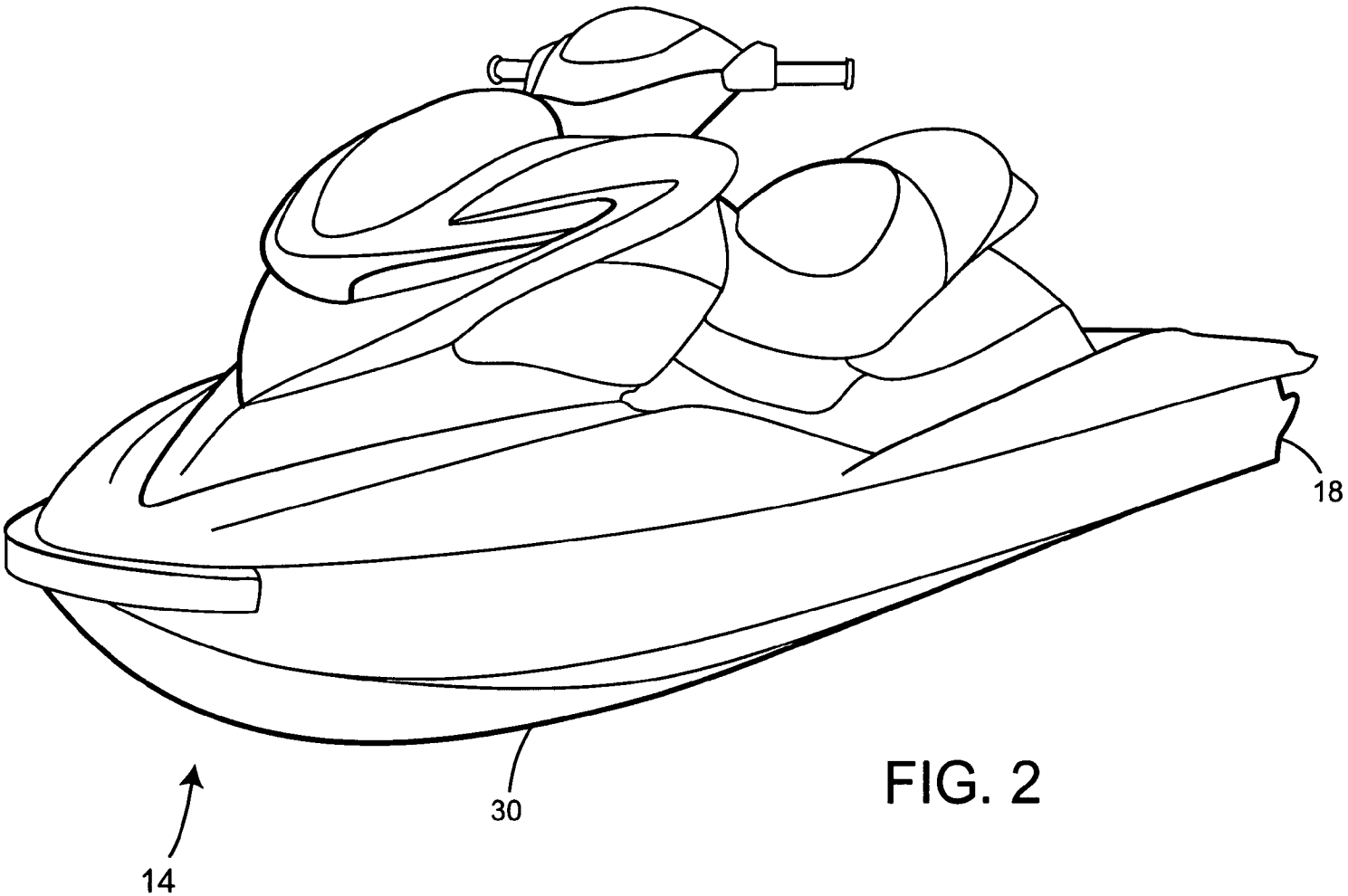
FIG. 2 is a perspective view of a jet watercraft of the type known and available in the art to carry and transport one or more persons over a surface of a body of water.
Figure 3:
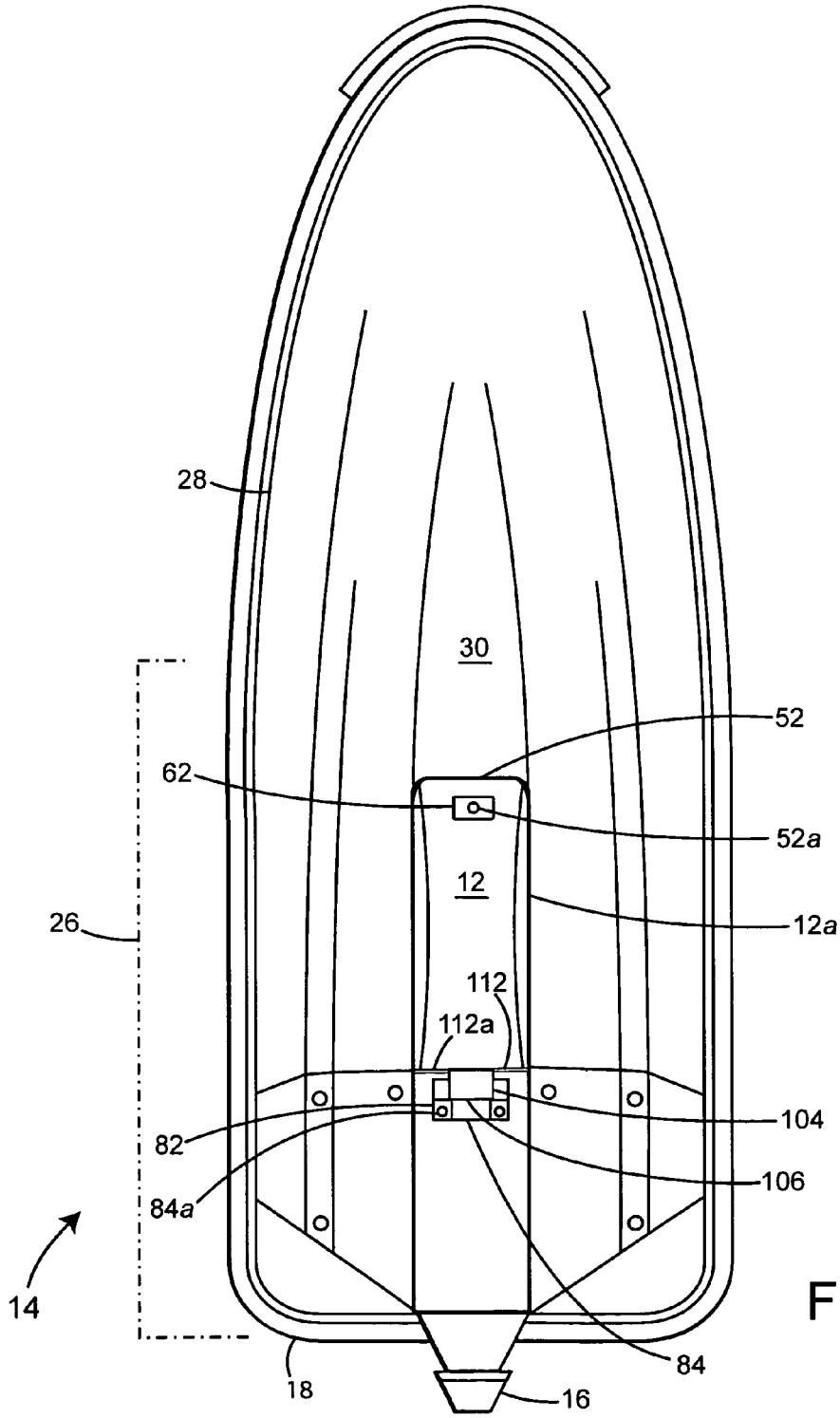
FIG. 3 is a bottom plan view of a hull of a jet watercraft having a water intake port for receiving water and a constriction nozzle located at a rear side of the jet watercraft for forcibly propelling water outwardly therefrom.

Reference is now made to FIG. 1 of the drawings illustrating a water intake grill 10 for attachment to a water intake port 12 of a jet watercraft 14 of the type commonly known in the art to carry and transport one or more persons over a surface of a body of water. The jet watercraft, as depicted in FIGS. 2 and 3, generally includes means for drawing into the water intake port a predetermined volume of water and expelling the water forcibly outward from a constricting nozzle 16 located at a rear side 18 of the jet watercraft 14. In most jet watercraft configurations, notably of the type shown in FIG. 4, water drawing means typically comprises a mixed flow impeller 20 housed within a centralized casing 22 in hydraulic communication with the water intake port and constricting nozzle 16 and connected to a drive shaft 24 which is rotatably driven by an internal combustion engine (not shown) located near a rear-to-mid sectional portion 26 of the jet watercraft, as shown by the bounded line in FIG. 3. The intake of water into and through the water intake port 12 may supplement cooling of the internal combustion engine via a plurality of open duct ways (not shown) in hydraulic communication with the centralized casing and internally housed and routed within an engine compartment of the jet watercraft 14 and/or solely within the configuration of the combustion engine. Other and more modern jet watercraft configurations may eliminate the open duct ways entirely and rely on most part on a closed cooling system (not shown) to eliminate any introduction of debris and like matter that may hamper effective cooling of the combustion engine. It is noted herein that the water intake grill 10 of the present invention is primarily directed and suited for application in both configurations described above, specifically being configured in the former to minimize the passing of debris and like foreign mater into the water intake port 12 and open duct ways that may rise to compromised performance or entire breakdown of the jet watercraft 14 due to inadequate cooling of the combustion engine and in the later and former to mitigate the passing of moderately-sized rocks through the water intake port and into the centralized casing 22 that may inadvertently strike and damage the mixed flow impeller 20 and associated operable components like the drive shaft 24 residing therewithin.

Figure 5:
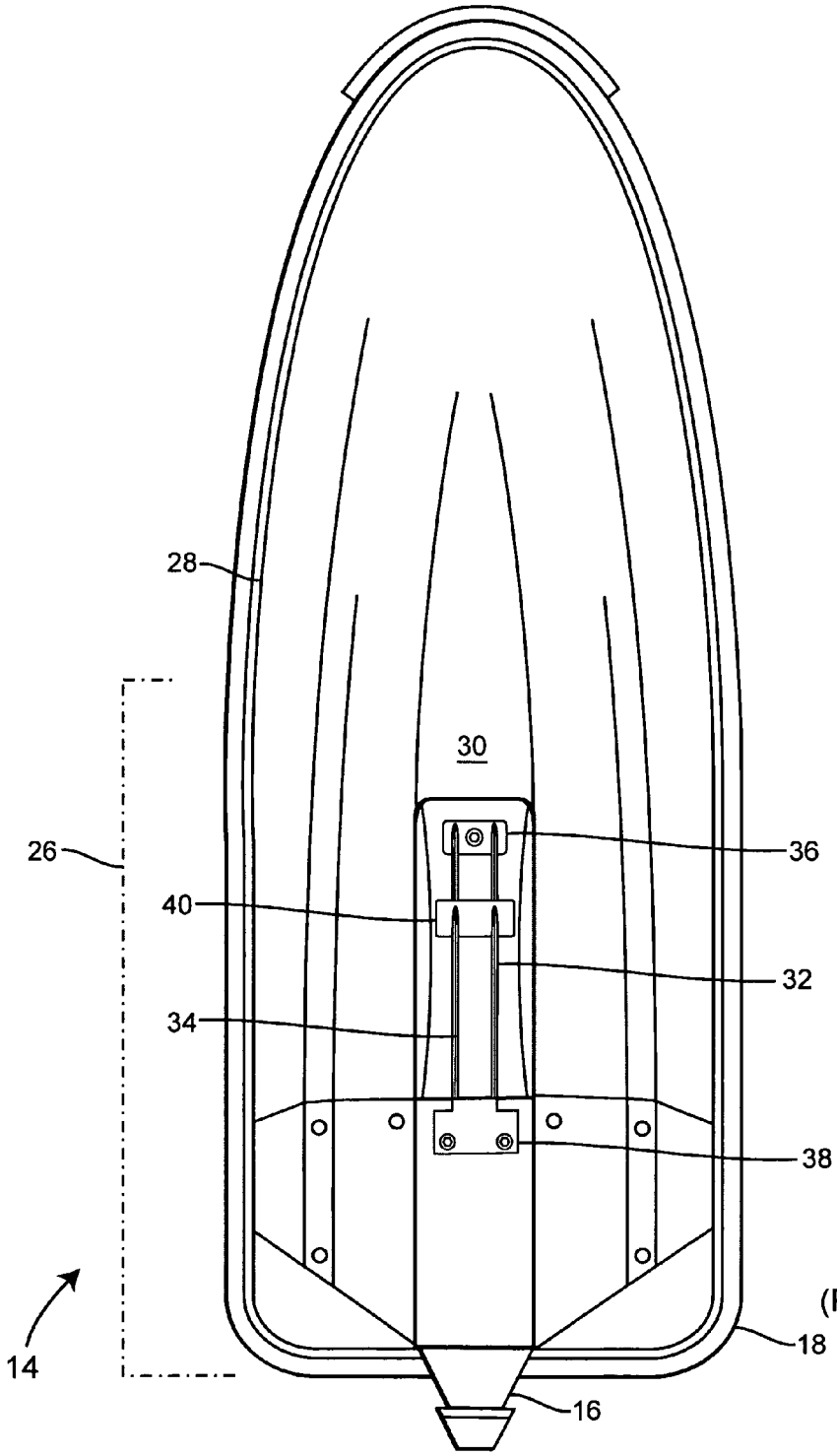
FIG. 5 (PRIOR ART)
FIG. 5 is a bottom plan view of a hull of a stock jet watercraft equipped with an intake guard of the type typically known in the art and mounted to a water intake port of the jet watercraft.
Figure 6:
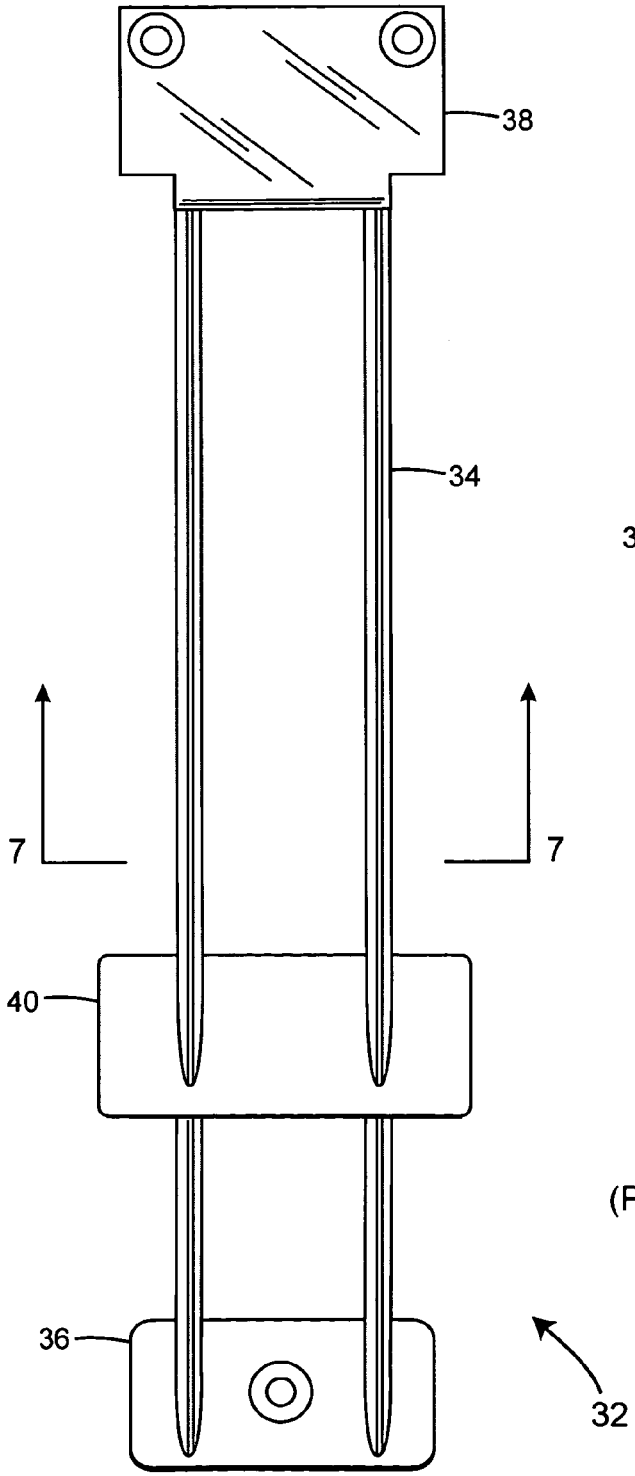
FIG. 6 (PRIOR ART)
FIG. 6 is a bottom plan view of an intake guard of the type known in the art and configured for attachment to a water intake port of a stock jet watercraft.
Figure 7:
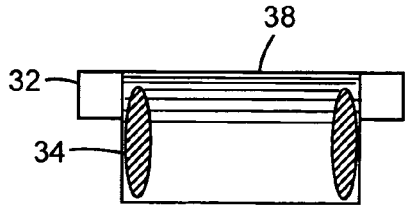
FIG. 7 (PRIOR ART)
FIG. 7 is a cross sectional view of an intake guard taken along line 7-7 in FIG. 6 illustrating a pair of extended finned members.

As illustrated in FIGS. 3 and 5, the water intake port 12 present in a stock jet watercraft is typically located about an underside portion 28 of a jet watercraft's hull 30, approximately one-third distance from the rear side 18 of the jet watercraft. In stock jet watercraft configurations, the water intake port is preferentially fitted with a factory-installed intake guard 32, typically of the type shown in FIGS. 6 and 7 to comprise a pair of extended finned members 34 situated in between and having ends connected to fore and aft stock mounts 36, 38. In some design configurations, the intake guard 32 may comprise an updraft fin 40 positioned midway within and mounted to the extended fin members to forcefully move water upwardly into the water intake port. The fore and aft stock mounts of the type configured for jet watercraft 14 in particular may include a number of design configurations to further adapt to the unique design characteristics and structural features of the water intake port incorporated and inherently included in many of today's jet watercraft, such as those manufactured and made available by Kawasaki Corporation and Suzuki Corporation, both of Japan.

Figure 8:
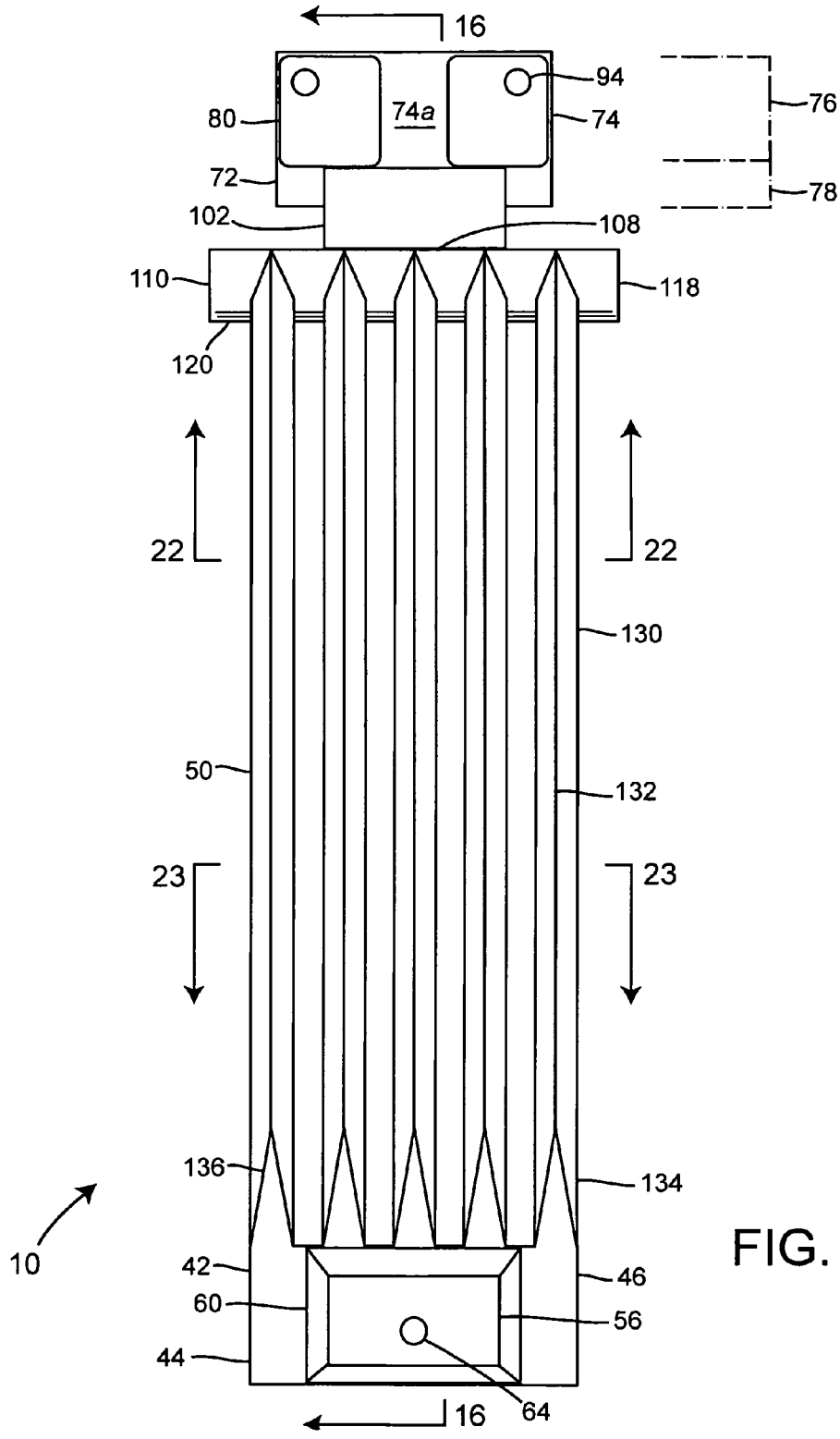
FIG. 8 is a top plan view of the preferred embodiment of the present invention illustrating a plurality of elongate members situated in between and connected to fore and aft mounts.
Figure 9:
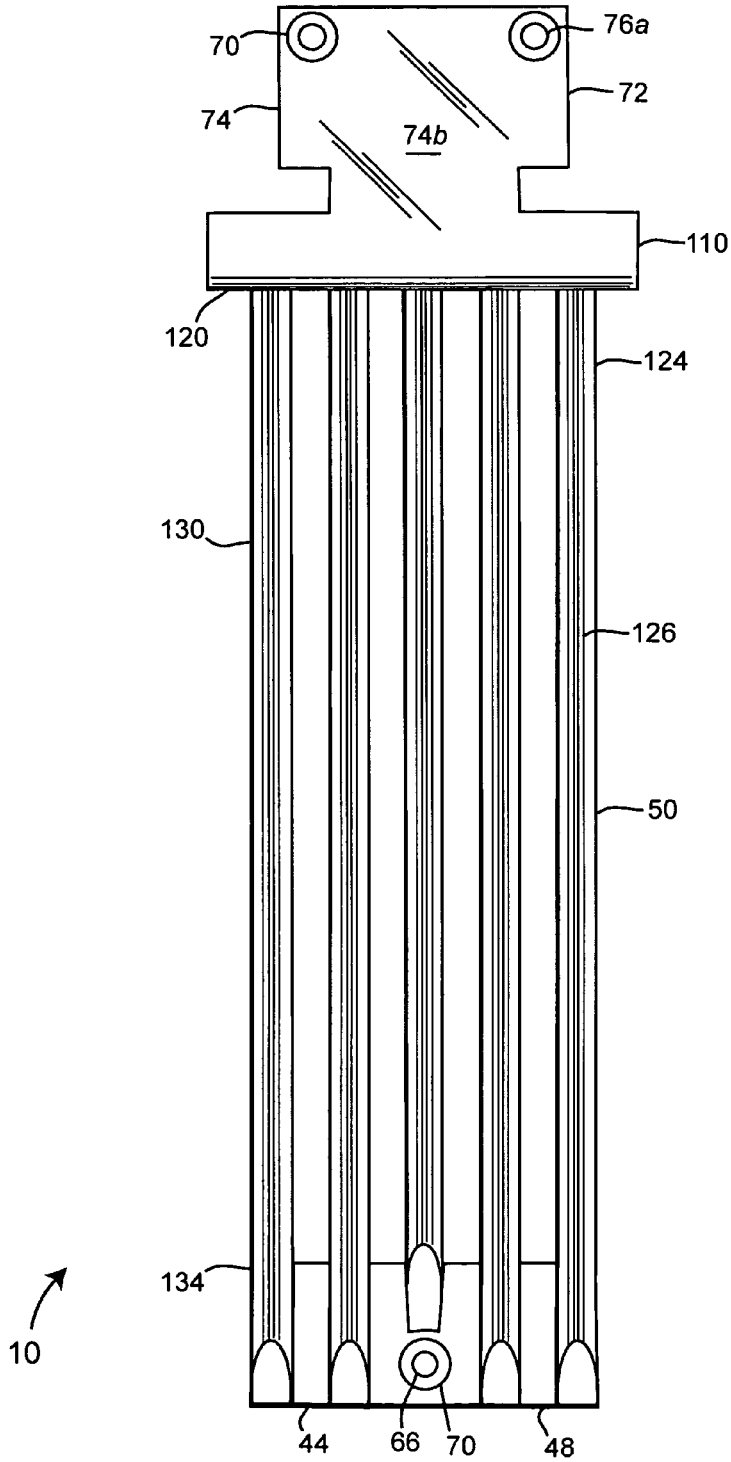
FIG. 9 is a bottom plan view of the preferred embodiment of the present invention illustrating a plurality of elongate members situated in between and connected to fore and aft mounts.

A fore mount 42 of the present invention, as illustration in FIGS. 8 and 9, incorporates a base 44 having angularly orientated top and bottom surfaces 46, 48 in relation to a plurality of elongate members 50, preferentially coinciding with the positional or angular orientation of a forward wall section 52 of the water intake port 12 shown in FIG. 3. Optionally fitted atop the angularly orientated top surface 46, as illustrated in FIGS. 8 and 9, is at least one key element 54, preferably being configured as a detachable element from the water intake grill, or alternatively, integrally connected to the angularly orientated top surface for ease of manufacture and more permanent placement.

Figure 4:
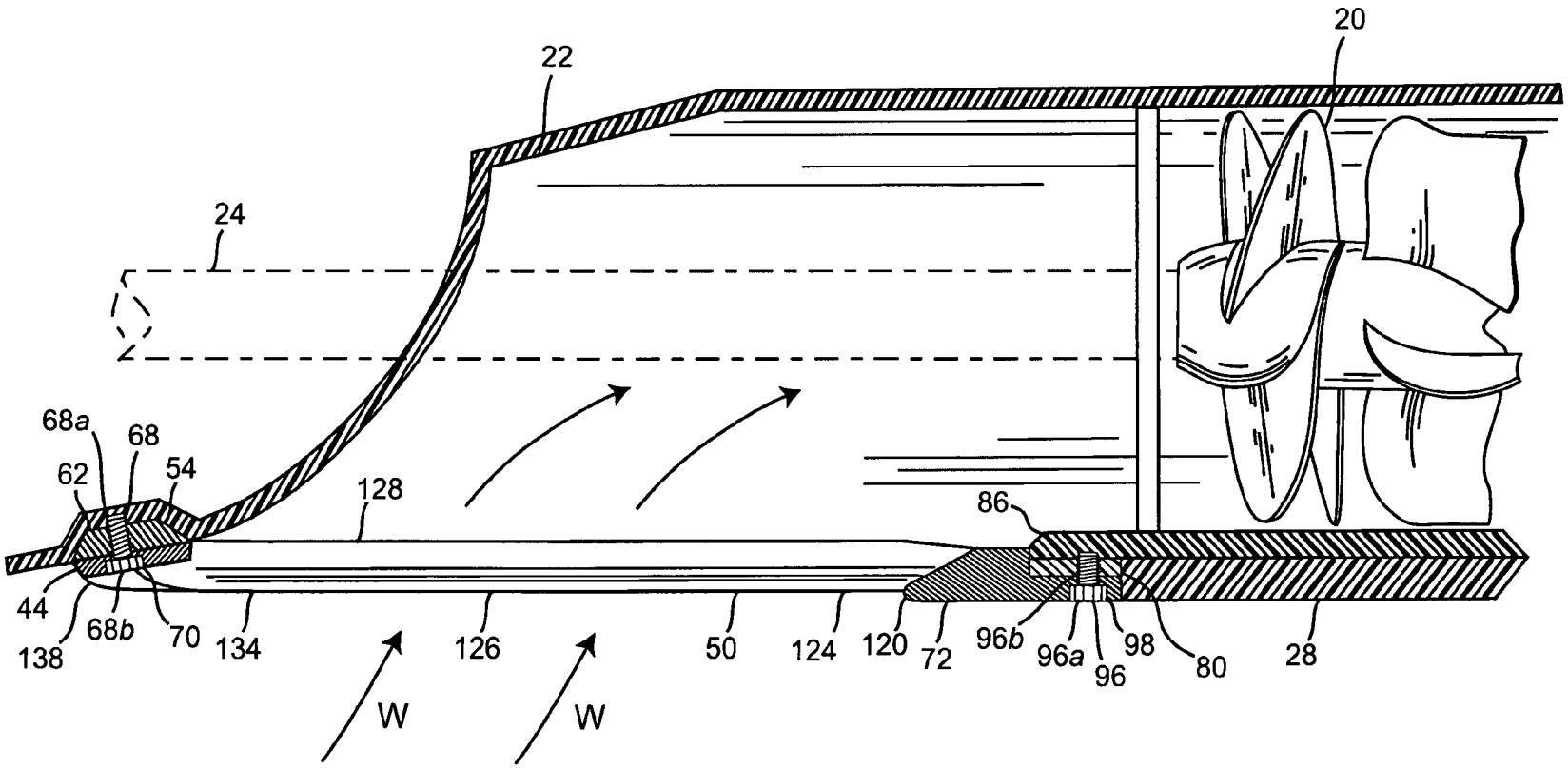
FIG. 4 is a partial cross sectional view of a water intake port of a stock jet watercraft equipped with a water intake grill of the present invention and a mixed flow impeller of the type associated with the jet watercraft.
Figure 10:
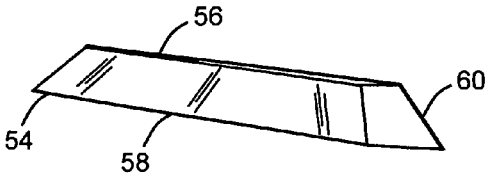
FIG. 10 is a perspective view of the preferred embodiment of the present invention illustrating a detachable key element.
Figure 11:
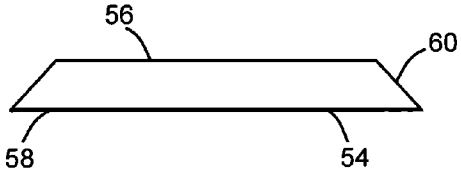
FIG. 11 is a front elevational view of the preferred embodiment of the present invention illustrating a detachable key element.
Figure 12:
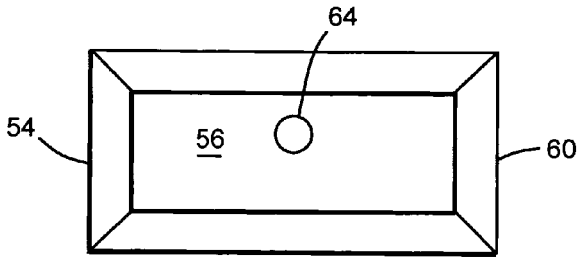
FIG. 12 is a top plan view of the preferred embodiment of the present invention illustrating a detachable key element.
Figure 16:
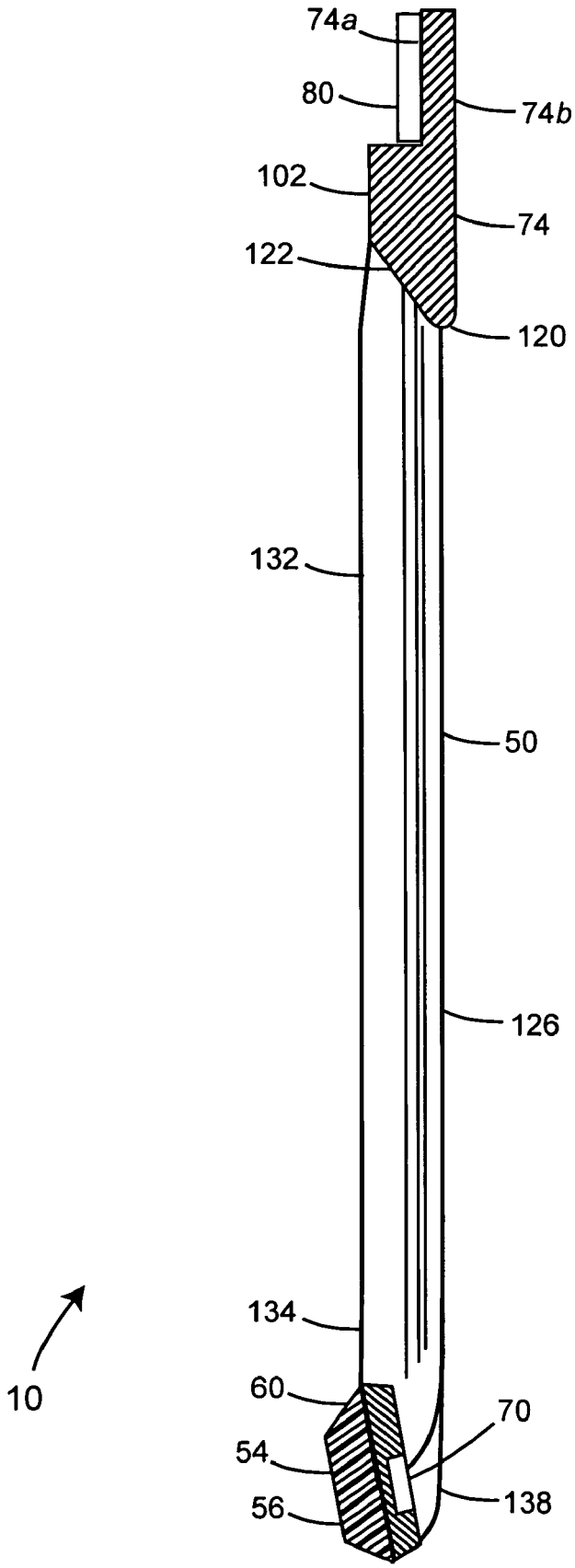
FIG. 16 is a cross sectional view of the preferred embodiment of the present invention taken along line 16-16 in FIG. 8 illustrating a key element resting atop a fore mount and a spacer resting atop an aft mount.

Regardless of its means of attachment to the angularly orientated top surface, the key element preferentially comprises top and bottom facing sides 56, 58 integrally connected by pitched sides 60 to form an overall geometric structure substantially coinciding to fit within the geometric configuration of a mount socket 62 integral to the forward wall section 52 of the water intake port. It is expressly noted herein that the key element 54, as represented in FIGS. 10-12, may comprise alternative geometric configurations other than the one previously described, preferably to the extent that it corresponds and configurably fits within the geometric confines and shape of the mount socket 62 of the forward wall section to ensure correct orientation of the fore mount 42 and consequentially the water intake grill 10 within the structural configuration of the water intake port 12. Extending through the key element 54 is at least one aperture 62 configured to align with an equal number of apertures 66 extending through the base, primarily for which is suited to accept therethrough a mount bolt 68 or an equivalent type of fastener. The mount bolt in this strict application, as shown in FIG. 4, comprises a threaded end 68*a* for threadably engaging a threaded aperture 52*a* integral to the forward wall section 52, whereupon its final placement sufficiently serves to simultaneously retain the position of the key element 54 relatively about the angularly orientated top surface 46, if detachably configured from the water intake grill as noted above, and tightly secure the fore mount of the water intake grill 10 to the water intake port. The base's aperture, as shown in FIGS. 9 and 16, may be further associated with a circular recess 70 inwardly extending partway into the angularly orientated bottom surface 48 of the base to conceal a head portion 68*b* of the mount bolt to further streamline the appearance of and permit unobstructive water flow over and around the water intake grill 10 while attached to the jet watercraft.

Figure 13:
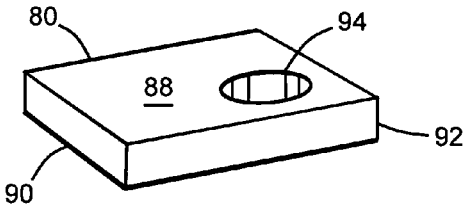
FIG. 13 is a perspective view of the preferred embodiment of the present invention illustrating a spacer.
Figure 15:
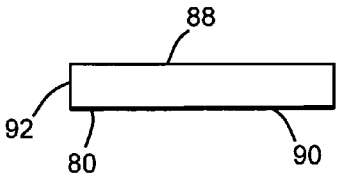
FIG. 15 is a front elevational view of the preferred embodiment of the present invention illustrating a spacer.
Figure 14:
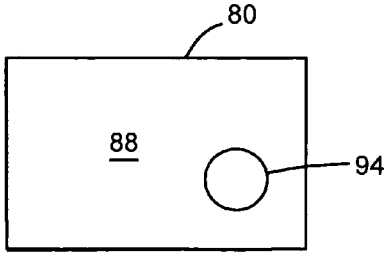
FIG. 14 is a top plan view of the preferred embodiment of the present invention illustrating a spacer.

Referring now to FIG. 8, an aft mount 72 of the present invention is preferably shown to comprise a horizontally positioned base 74 generally divided into rearward and forward sections 76, 78 (as shown by bounded lines) and having top and bottom planar surfaces 74*a*, 74*b*. Preferentially associated with the top planar surface of the horizontally positioned base, specifically about the rearward section 76, is a pair of spacers 80, discernibly configured to fit within a preselect arrangement of primary mount sockets 82 notably present in a rearward recess 84 of a rearward wall section 86 of the water intake port. The spacers in this regard assistively serve to support and lock the aft mount of the water intake grill 10 within the rearward recess 84 and elevate the horizontally positioned base in such manner to allow the bottom planar surface 74*b* thereof to positionally coincide with the level of the underside portion 28 of a jet watercraft's hull 30, a transitional configuration which mitigates a condition of turbulent water flow thereover that can adversely affect and hamper the operation and performance of the jet watercraft. Each spacer 80, particularly of the type shown in FIGS. 13-15, is associated with top and bottom sides 88, 90 integrally connected along their respective peripheries by a perpendicular wall 92 to form an overall geometric configuration most resembling a square block. Preferably, at least one aperture 94 extends through each spacer and aligns with an equal number apertures 76*a* generally passing through the rearward section of the horizontally positioned base 74, particularly being suited to receive therethrough a mount bolt 96 or an equivalent type of fastener. The mount bolt in this regard supplementally serves to retain the position of the spacer relatively about the horizontally positioned base, if detachably configured from the water intake grill as noted downbelow, and partially secure the water intake grill 10 about the water intake port 12, primarily by means of its insertion through the aligned apertures 76*a*, 94 and its threaded end 96*b* being threadably engaged with a threaded aperture 84*a* present in the rearward recess 84 of the rearward wall section. Like the angularly orientated bottom surface 48 described above, each of the apertures of the rearward section is generally associated with a circular recess 98 inwardly extending into the bottom planar surface 74*b* of the horizontally positioned base to conceal a head portion 96*a* of the mount bolt 96, purposefully to facilitate a streamlined appearance of and permit unobstructed water flow over and around the water intake grill 10 while it is mounted to the water intake port 12. Akin to the key element 54 associated with the angularly orientated top surface, the spacers 80 may be detachably configured from the water intake grill to permit and simplify alteration of the geometric configuration thereof to meet and coincide with the manufacturer's specification and geometry of the mount sockets that may reside within the rearward recess 84. In other related embodiments of the water intake grill, the spacers may be integrally connected and made part of the horizontally positioned base 74 for more permanent placement with enhanced effect of supplementing the overall strength and structural integrity of the water intake grill 10.

It is worthy to note that the fore and aft mounts 42, 72 described herein and shown elsewhere in the accompanying figures may eliminate the need or comprise one or more key elements 54 or spacers 80, respectively, to further the correct position and permit secure attachment of the water intake grill relatively about the water intake port 12. The number and configuration of each key element or spacer optionally associated with any one, overall configuration of the water intake grill largely depends on the manufacturer's layout and mount socket configuration associated with the water intake port. For this reason, the described configuration of the aft and fore mounts integrated into the water intake grill 10 of the present invention is not to be construed as a strict limitation to the specific embodiments described herein; alternative configurations or pattern layouts of the key elements, spacers or even none at all is further contemplated herein. In the instance of eliminating the presence of spacers 80, it is further contemplated that the horizontally positioned base of the aft mount may be appropriately sized or thickened in construction at preselect areas to the extent that the bottom planar surface 74*b* thereof relatively resides in a flush position with respect to the underside portion 28 of a jet watercraft's hull 30 to minimize a condition of turbulent water flow or preferentially promote laminar flow over the water intake grill. However, this may unnecessarily increase the overall weight of the water intake grill, making it less desirable to the enthusiast seeking a less-weighted jet watercraft to gain utmost performance therefrom.

Figure 17:
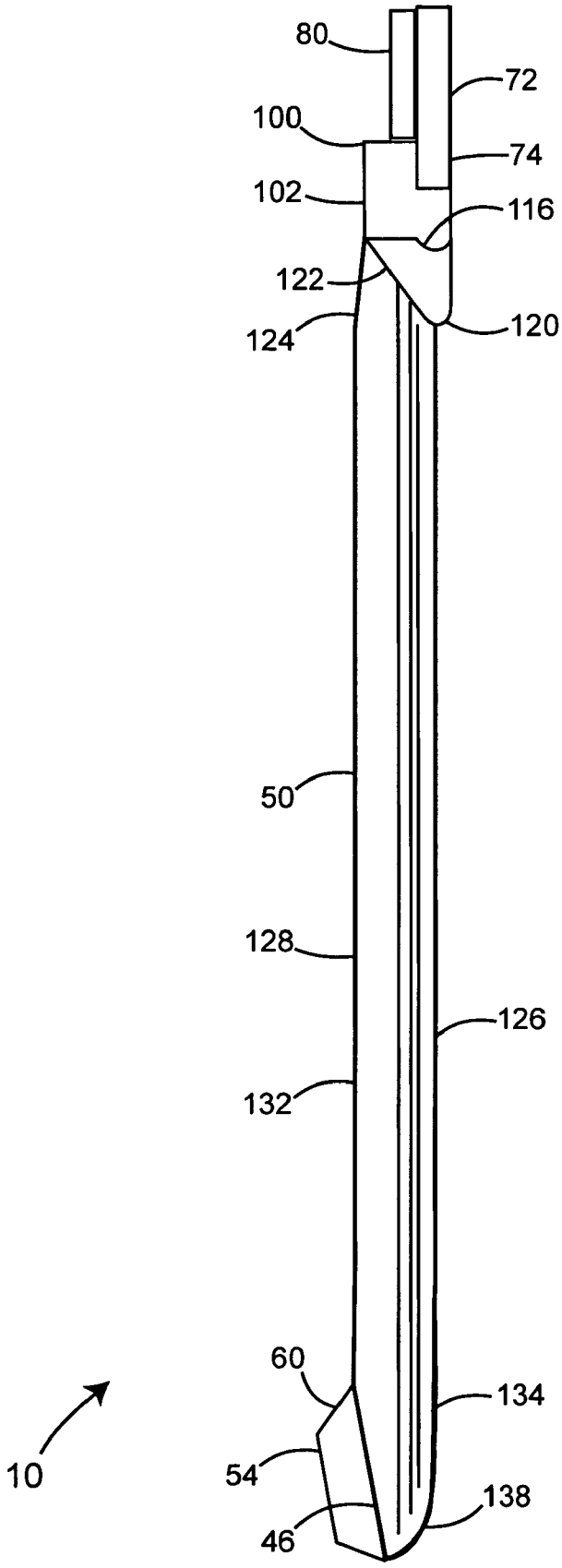
FIG. 17 is a side elevational view of the preferred embodiment of the present invention illustrating a key element situated atop a base of a fore mount and a spacer situated atop a horizontally positioned base of an aft mount.

Referring now to FIG. 8, the forward section 78 is generally defined as occupying approximately one-third of the surficial area of the horizontally positioned base 74 for which is particularly suited to receive and mount thereon a rearward end 100 of an extension support 102 having a predetermined length. The rearward end is preferentially shown in FIG. 9 to comprise a predetermined geometric configuration whose height generally extends above each of the spacers 80 and engagingly fits within a secondary mount socket 104 primarily occupying an intermediate section 106 associated with the rearward recess 84. Similar to the spacers in terms of function, the rearward end secondarily supports and locks into place the water intake grill 10 to prevent its lateral movement relatively within the rearward recess. The extension support is further shown in FIGS. 8 and 17 to a comprise a forward end 108 integrally connected midway along a cross support member 110 that extends substantially perpendicular to the extension support 102 and upon installation of the water intake grill to the jet watercraft extends parallel to a back leading edge 112 generally associated with the rearward wall section 86.

Figure 18:
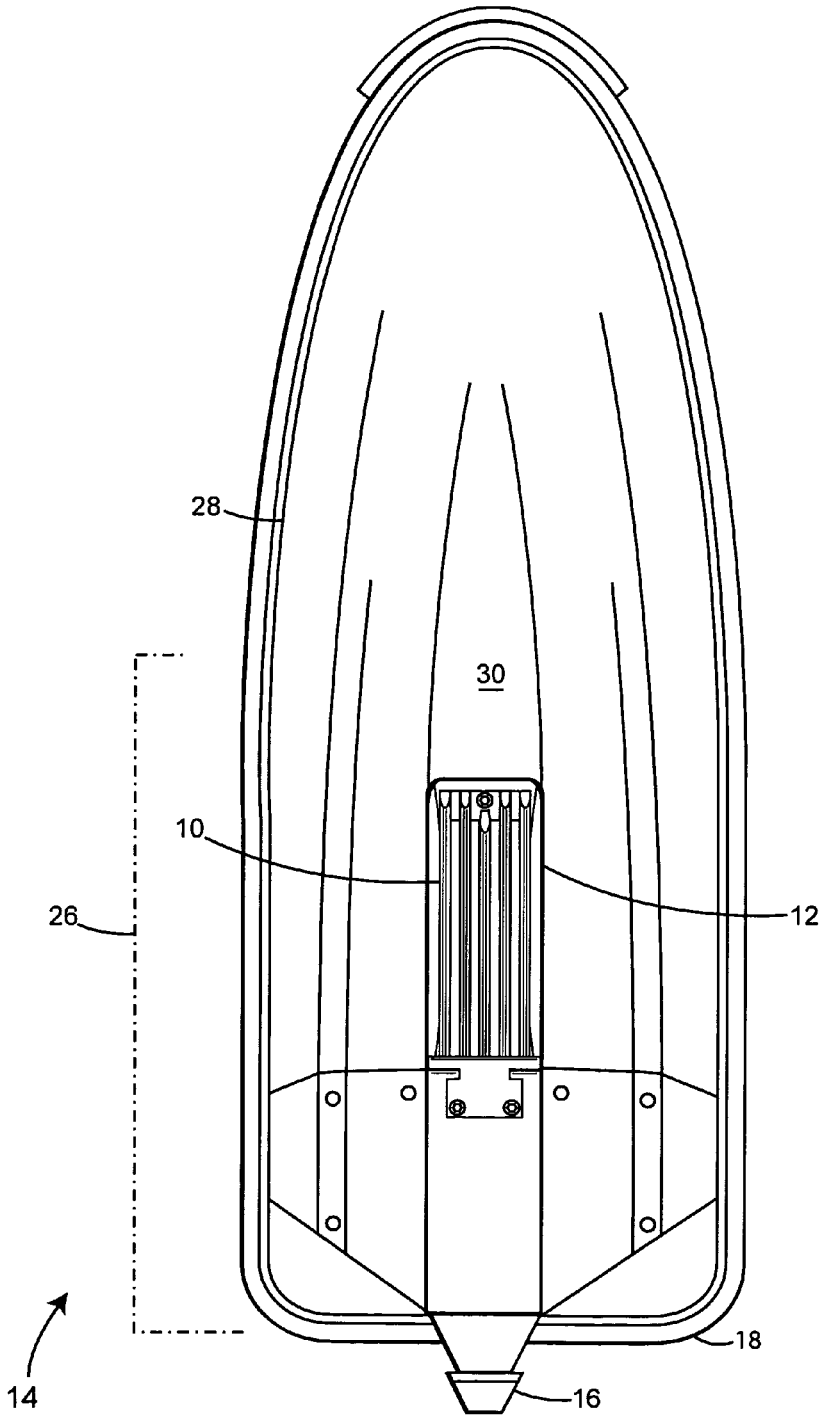
FIG. 18 is a bottom plan view of a hull of a stock jet watercraft equipped with a preferred embodiment of the present invention, specifically being mounted over a water intake port of the jet watercraft.

In some design configurations of jet watercraft 14, as shown in FIGS. 3 and 18, the water intake port 12 comprises a dimensional width sufficiently wider than that of the intermediate section 106 present within the rearward recess and a back leading edge that is convexly configured 112*a* relatively about both sides of the intermediate section to establish a streamline appearance about the rearward wall section of the water intake port. In accommodating this structural arrangement, particularly to attain the stated utilitarian aspects of the present invention, the cross support member 110, as depicted in FIG. 18, is configured to extend outwardly beyond sideward members 114 of the extension support so as to be positioned about the full dimensional width of the water intake port and comprises an inward concaved segment 116 preferably configured to geometrically correspond and coincide with the convexly-configured back leading edge 112*a* to establish an interlocking relationship with one another upon placement of the water intake grill about the water intake port. Consequently, by means of this geometric arrangement, the structural integrity and lateral stability of the water intake grill 10 is appreciably increased upon its installation on jet watercraft. In maintaining the purposeful functional aspects of the convexly configured back leading edge generally associated with stock jet watercraft, an outward side 118 of the cross support member comprises a lower convexed segment 120 to yield a uniform streamline appearance thereabout.

Figure 19:
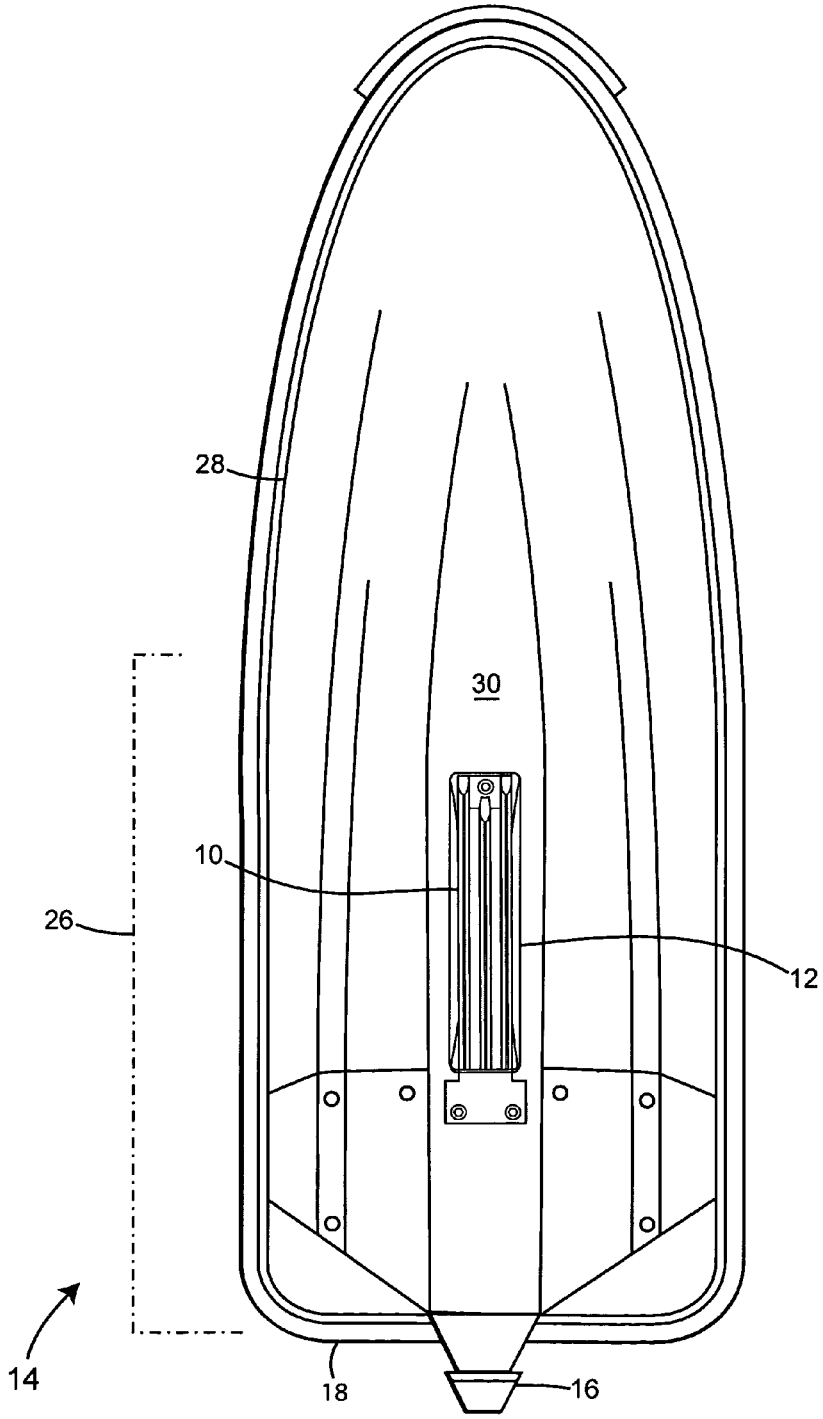
FIG. 19 is a bottom plan view of a hull of a stock jet watercraft equipped with an alternative embodiment of the present invention, specifically being mounted over a water intake port of the jet watercraft.
Figure 20:
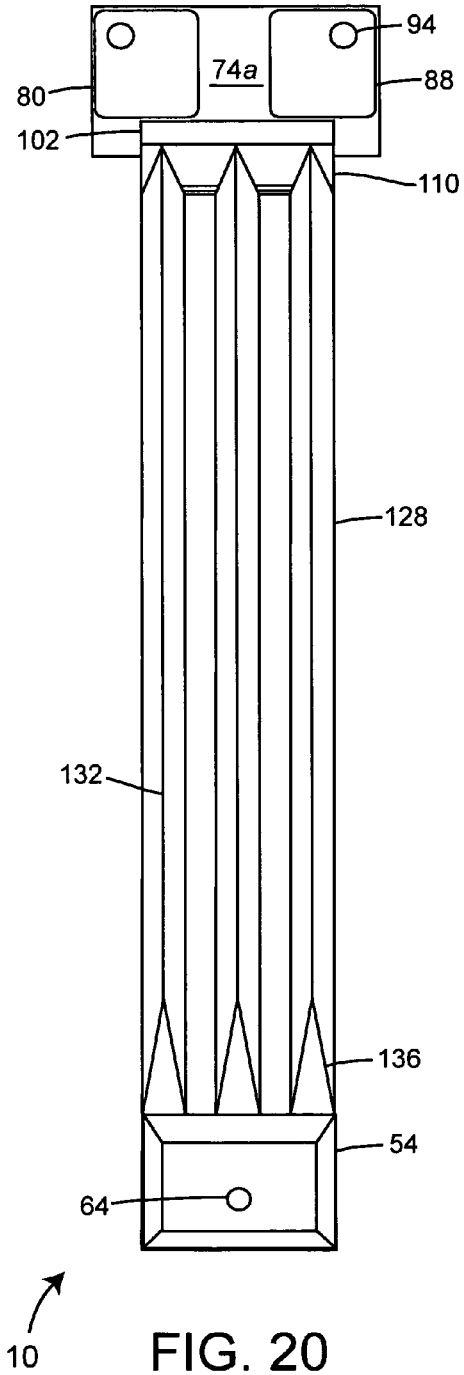
FIG. 20 is a top plan view of an alternative embodiment of the present invention illustrating a plurality of elongate members situated in between and connected to fore and aft mounts.
Figure 21:
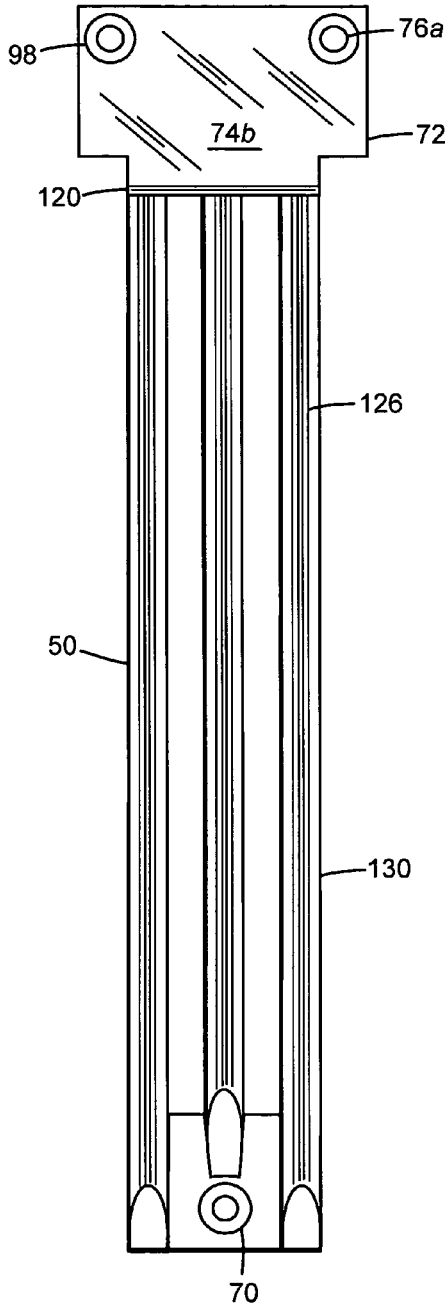
FIG. 21 is a bottom plan view of the alternative embodiment of the present invention illustrating a plurality of elongate members situated in between and connected to fore and aft mounts.

Conversely, in other design configurations of jet watercraft, the water intake port 12, as shown in FIG. 19, may comprise a narrower width relatively in between the sidewalls 12*a* than that described above, particularly one that substantially approximates the dimensional width of the intermediate section 106 of the rearward recess. In this regard, as illustrated in FIGS. 20 and 21, the water intake grill may alternatively comprise features of a cross support member 110 of shorter dimensional length, particularly being configured to correspond with the width of the intermediate section, and an extension support 102 of shorter dimensional length, particularly being configured to allow the outward side 118 of the cross support member to positionally coincide with the back leading edge 112 of the rearward wall section described hereinbefore. In instances where the back leading edge is convexly configured in the manner denoted above, the lower convexed segment 120 is present within the structure of the cross support member to provide for a streamline appearance entirely and linearly thereabout.

Figure 22:
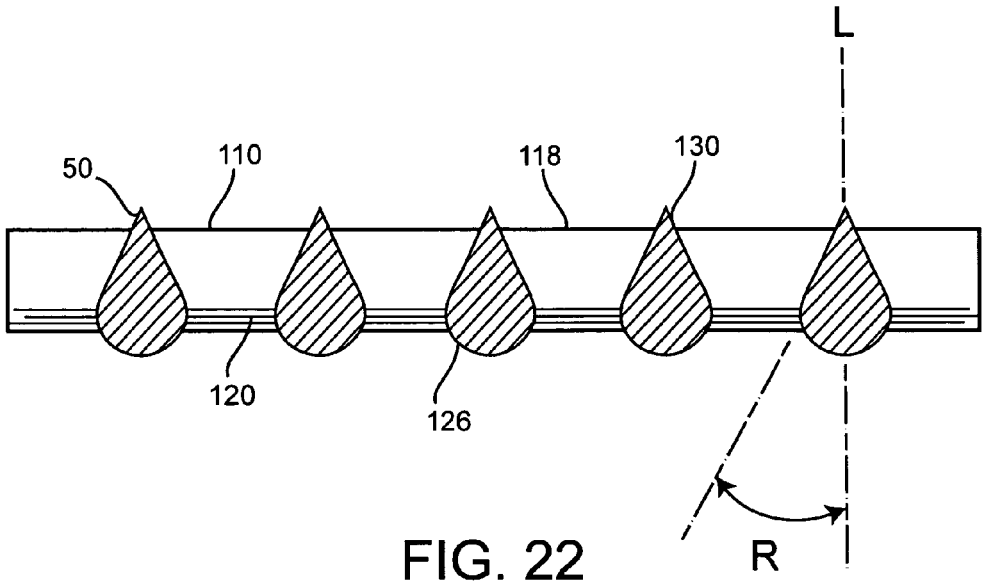
FIG. 22 is a cross sectional view of the preferred embodiment of the present invention taken along line 22-22 in FIG. 8 illustrating a plurality of elongate members integrally connected to an angular edge of a cross support member.
Figure 23:
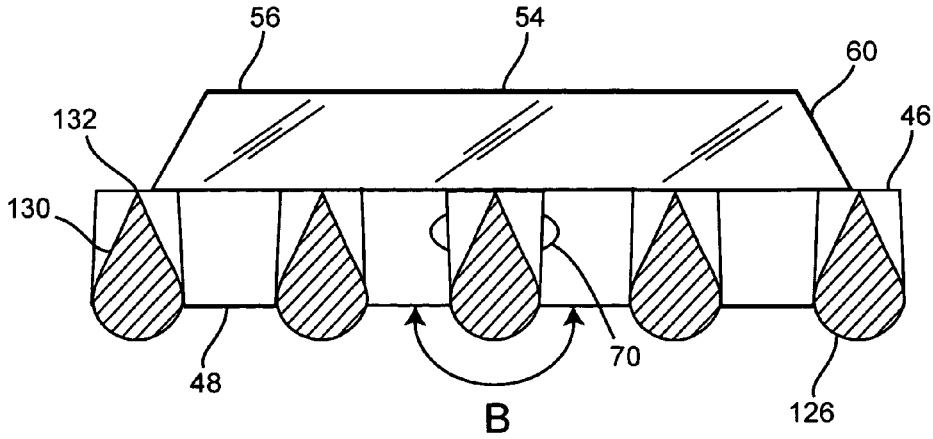
FIG. 23 is a cross sectional view of the preferred embodiment of the present invention taken along line 23-23 in FIG. 8 illustrating a plurality of elongate members integrally connected to a base and a key element mounted atop a fore mount.

Referring now to FIGS. 8 and 22, the outward side 118 of the cross support member 110 is further associated with an angular edge 122 integrally connected thereto for receiving and attaching second ends 124 of the elongate members 50, generally transitioning from and residing above the lower convexed segment 120. Each elongate member 50 of the water intake grill, as specifically illustrated in FIG. 23, comprises a teardrop geometric profile or a profile resembling an airfoil of an airplane's wing to permit or promote a condition of laminar water flow over the set of elongate members 50 while restricting the passage of most debris and foreign matter that may hamper engine performance of the jet watercraft 14, as previously discussed elsewhere herein. A plurality of lines designated as W in FIG. 4 indicates the general direction of water flow to establish this preferred laminar condition. A cross sectional view of the elongate member, as depicted in FIG. 23, reveals an outward bottom section 126 having a general rounded appearance, a configuration of which primarily functions to shed away debris or lessen the accumulation of debris at the water intake port 12 insofar to permit continued passage of water into the water intake port for sustained engine performance. Arc B in FIG. 23 defines the extent for which the outward bottom section 126 of the elongate member is considered as having a preferred rounded appearance. As illustrated in FIG. 22, each elongate member 50 is further associated with a tapered top end 128 having sides 130 commencing from an apex 132 and extending angularly outward toward the outward bottom section. In the preferred embodiment of the water intake grill 10, an angular orientation R of 25 degrees establishes the angular extent to which the sides 130 are positioned relative to axis L shown in FIG. 22. A minimum intake opening of at least ⅜ inch, as shown in FIG. 18, is held in between each of the elongate members 50 and adjacent sidewalls 12*a* of the water intake port 12, preferentially of which establishes a reduction of passing debris into the water intake port while permitting a sufficient water flow through the water intake grill 10 and into the water intake port to yield sustained cooling of the combustion engine and maintain efficient performance of the propulsion system of the jet watercraft.

Further shown in FIGS. 8 and 20, a first end 134 of the elongate member preferably comprises a splayed outward portion 136 to strengthen and enhance the structural integrity of the connection in between the elongate member 50 and fore mount's base 44 and allow the first end thereof to transitionally meet the position of the angularly orientated top surface 46. An integral elbow 138 of the preferred type illustrated in FIG. 1 is generally associated with the first end of each elongate member to further streamline the appearance of the set of elongate members 50 while attached to the fore mount 42 and provide for a condition of laminar water flow over the water intake grill 10 and the boat's hull 30 during operation of the jet watercraft 14 in a body of water.

It can be seen from the foregoing that there is provided in accordance with this invention a simple and easily operated device, which is particularly suited for attachment to a water intake port 12 of a jet watercraft 14 of the type noted in the art to carry and transport one or more persons over a surface of a body of water. Prolonged testing of the water intake grill 10 reveals improved performance of the jet watercraft over the intake guard 32 in stock arrangements, primarily due to its effectiveness in shedding away and mitigating entry of waterborne debris such as suspended weeds and rocks of moderate to large size into the water intake port of the jet watercraft. Through the reduction and even elimination of such debris from the water intake port 12, sustained cooling of the combustion engine and reduced damage to the mixed flow impeller 20 and associated operable components are appreciably apparent to the extent of permitting relied operation and performance of the jet watercraft as configured and designed by the manufacturer.

It is obvious that the components comprising the water intake grill may be fabricated from a variety of materials, providing such selection or use of materials possess the capacity to withstand forces acting thereon throughout its duration of use on a jet watercraft. Accordingly, it is most desirable, and therefore preferred, to construct the water intake grill 10 from steel coated with a polymeric or epoxy paint or equivalent, stainless steel, aluminum, or an equivalent type of material capable of preventing premature corrosion of the substrate while in the presence of a fresh or salt water environment. To lessen the cost and simplify construction of the water intake grill and increase its overall structural integrity, the fore and aft mounts 42, 72 as well as the set of elongate members 50 are preferably fabricated as a unified structure, typically by means of cast molding or an equivalent form of technology. As for related components, the key element 54 and spacers 80 collectively described herein may be integrated within the overall unified structure of the water intake grill 10 to simplify the manufacture process or manufactured separably therefrom to easily accommodate for periodic design alterations or changes to the geometric arrangement of the mounts sockets that may occur from time to time by the manufacturers of jet watercraft. Regardless of the attachment methodology, the key element and spacers may be fabricated from equivalent corrosive materials noted above or alternatively from a durable, high-density polymeric material.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A water intake grill for attachment to a water intake port having a pair of sidewalls and forward and rearward wall sections each being associated with at least one or more mount sockets, said intake grill comprising, in combination:

a fore mount having a base with angularly orientated top and bottom surfaces substantially coinciding with the positional orientation of the forward wall section;

an aft mount having a horizontally positioned base substantially coinciding with the positional orientation of the rearward wall section;

a cross support member having an outward side extending distantly outward from said horizontally positioned base a predetermined amount;

means for anchoring said fore and aft mounts to the forward and rearward wall sections of water intake port, respectively; and a plurality of elongate members each having first and second ends and a teardrop geometric profile incorporating a tapered top end and an outward bottom section having a general rounded appearance, said first and second ends of each elongate member being integrally connected to said angularly orientated bottom surface of base and to said outward side of cross support member, respectively, said tapered top end of elongate member having an apex and a pair of sides each commencing from said apex and extending angularly outward a predetermined amount from a longitudinal axis extending through said apex and said outward bottom section.

2. An intake grill as set forth in claim 1, wherein said fore and aft mounts each comprise at least one aperture extending therethrough to receive said anchoring means.

3. An intake grill as set forth in claim 2, wherein said anchoring means comprises a mount bolt passing through each of said apertures of fore and aft mounts and having a threaded end threadably engaging a threaded aperture integrally included in each of the forward and rearward wall sections of water intake port.

4. An intake grill as set forth in claim 2, wherein said fore mount supplementally comprises at least one key element mounted atop of said angularly orientated top surface.

5. An intake grill as set forth in claim 4, wherein said key element comprises top and bottom facing sides integrally joined by pitched sides to form a unified, geometric structure substantially suited to conformably fit within the geometric configuration of the mount socket of forward wall section and an aperture extending therethrough to align with said aperture of fore mount, said bottom facing side being selectively orientated to engage and rest atop said angularly orientated top surface of base.

6. An intake grill as set forth in claim 1, wherein said aft mount supplementally comprises at least one spacer mounted atop said horizontally positioned base for positioning within the mount socket of rearward wall section.

7. An intake grill as set forth in claim 6, wherein said spacer comprises top and bottom surfaces integrally joined along their respective peripheries by a perpendicular wall to form a unified, geometric structure substantially suited to conformably fit within the geometric configuration of the mount socket of rearward wall section and an at least one aperture extending therethrough to correspond and align with an equal number of apertures extending through said horizontally positioned base.

8. An intake grill as set forth in claim 1, further comprising an extension support for extendably supporting said cross support member distantly apart from said horizontally positioned base a predetermined amount, said extension support having sideward members and rearward and forward ends integrally connected to said horizontally positioned base of aft mount and said cross support member, respectively.

9. An intake grill as set forth in claim 8, wherein said outward side of cross support member comprises a lower convexed segment and an angular edge transitioning from and residing above said lower convexed segment for attaching thereto said second ends of elongate members.

10. An intake grill as set forth in claim 9, wherein said cross support member comprises an inward concaved segment and extends perpendicularly outward beyond said sideward members a predetermined amount to permit said inward concaved segment to engage and interlock with a convexly configured back leading edge associated with the rearward wall section.

11. An intake grill as set forth in claim 1, wherein said outward side of cross support member comprises a lower convexed segment positionally coinciding with a convexly configured back leading edge associated with the rearward wall section.

12. An intake grill as set forth in claim 1, wherein said first end of elongate member comprises a splayed outward portion to strengthen the connection thereat and an integral elbow to minimize its obstructiveness.

13. An intake grill as set forth in claim 1, wherein each of said sides of tapered top end extends angularly outward 25 degrees from a longitudinal axis extending through said apex and said outward bottom section.

14. An intake grill as set forth in claim 1, wherein said elongate members are held apart from one another and sidewalls of water intake port to form thereinbetween a minimum intake opening of at least ⅜ inch.

15. A water intake grill for attachment to a water intake port having a pair of sidewalls and forward and rearward wall sections each being associated with at least one or more mount sockets, said intake grill comprising, in combination:

a fore mount having a base with angularly orientated top and bottom surfaces substantially coinciding with the positional orientation of the forward wall section and at least one aperture extending therethrough for accepting a mount bolt for attaching said fore mount to forward wall section, said angularly orientated top surface supplementally having at least one key element engaging and resting atop thereof;

an aft mount having a horizontally positioned base substantially coinciding with the positional orientation of the rearward wall section and at least one aperture extending therethrough for accepting a mount bolt for attaching said aft mount to rearward wall section, said horizontally positioned base supplementally having at least one spacer engaging and resting atop thereof;

a cross support member having an outward side, said outward side having a lower convexed segment and an angular edge transitioning from and residing above said lower convexed segment;

an extension support having sideward members and rearward and forward ends integrally connected to said horizontally positioned base and said cross support member, respectively; and a plurality of elongate members each having first and second ends and a teardrop geometric profile incorporating a tapered top end and an outward bottom section having a general rounded appearance, said first end being integrally connected to said angularly orientated bottom surface of base and said second end being integrally connected to said angular edge.

16. An intake grill as set forth in claim 15, wherein said key element comprises a geometric structure substantially suited to conformably fit within the geometric configuration of the mount socket of forward wall section and an aperture extending therethrough to correspond and align with said aperture of fore mount and said spacer comprises a geometric structure substantially suited to conformably fit within the geometric configuration of the mount socket of rearward wall section and at least one aperture extending therethrough to correspond and align with said aperture of aft mount.

17. An intake grill as set forth in claim 15, wherein said lower convexed segment of outward side positionally coincides with a convexly configured back leading edge associated with the rearward wall section.

18. An intake grill as set forth in claim 15, wherein said cross support member comprises an inward concaved segment and extends perpendicularly outward beyond said sideward members a predetermined amount to permit said inward concaved segment to engage and interlock with a convexly configured back leading edge associated with the rearward wall section.

19. An intake grill as set forth in claim 15, wherein said elongate members are held apart from one another and sidewalls of water intake port to form thereinbetween a minimum intake opening of at least ⅜ inch and said tapered top end of elongate member comprises an apex and a pair of sides each commencing from said apex and extending angularly outward 25 degrees from a longitudinal axis extending through said apex and said outward bottom section.

20. A water intake grill for attachment to a water intake port having a pair of sidewalls and forward and rearward wall sections each being associated with at least one or more mount sockets, said intake grill comprising, in combination:

a fore mount having a base with angularly orientated top and bottom surfaces substantially coinciding with the positional orientation of the forward wall section and at least one aperture extending therethrough for accepting a mount bolt for attaching said fore mount to forward wall section, said angularly orientated top surface supplementally having one key element engaging and resting atop thereof, said key element comprising a geometric structure substantially suited to conformably fit within the geometric configuration of the mount socket of forward wall section and an aperture extending therethrough to correspond and align with said aperture of fore mount;

an aft mount having a horizontally positioned base substantially coinciding with the positional orientation of the rearward wall section and at least one aperture extending therethrough for accepting a mount bolt for attaching said aft mount to rearward wall section, said horizontally positioned base supplementally having at least one spacer engaging and resting atop thereof, said spacer comprising a geometric structure substantially suited to conformably fit within the geometric configuration of the mount socket of rearward wall section and at least one aperture extending therethrough to correspond and align with said aperture of aft mount;

a cross support member having an outward side, said outward side having a lower convexed segment and an angular edge transitioning from and residing above said lower convexed segment;

an extension support having sideward members and rearward and forward ends integrally connected to said horizontally positioned base and said cross support member, respectively; and a plurality of elongate members each having first and second ends and a teardrop geometric profile incorporating a tapered top end and an outward bottom section having a general rounded appearance, said first end being integrally connected to said angularly orientated bottom surface of base and having a splayed outward portion to strengthen the connection thereat and transitionally meet said angularly orientated top surface and an integral elbow to minimize the obstructiveness of said elongate member, said second end being integrally connected to said angular edge.

21. An intake grill as set forth in claim 20, wherein said elongate members are held apart from one another and sidewalls of water intake port to form thereinbetween a minimum intake opening of at least ⅜ inch and said tapered top end of elongate member comprises an apex and a pair of sides each commencing from said apex and extending angularly outward 25 degrees from a longitudinal axis extending through said apex and said outward bottom section.

22. An intake grill as set forth in claim 21, wherein said extension support comprises a predetermined length to permit said lower convexed segment of outward side to positionally coincide with a convexly configured back leading edge associated with the rearward wall section.

23. An intake grill as set forth in claim 21, wherein said cross support member comprises an inward concaved segment and said extension support comprises a predetermined length to permit said inward concaved segment of cross support member to engage and interlock with a convexly configured back leading edge associated with the rearward wall section.

* * * * *